US007190384B2

(12) United States Patent
Imai

(10) Patent No.: US 7,190,384 B2
(45) Date of Patent: Mar. 13, 2007

(54) IMAGE FORMING APPARATUS AND DENSITY UNEVENNESS PREVENTING METHOD

(75) Inventor: Ryo Imai, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 240 days.

(21) Appl. No.: 11/048,847

(22) Filed: Feb. 3, 2005

(65) Prior Publication Data

US 2005/0168562 A1 Aug. 4, 2005

(30) Foreign Application Priority Data

Feb. 4, 2004 (JP) ..... 2004-028449

(51) Int. Cl.
*B41J 2/00* (2006.01)

(52) U.S. Cl. ..... 347/188

(58) Field of Classification Search ..... 347/171–172, 347/183–184, 188, 191, 193, 211; 400/120.01, 400/120.02, 120.07, 120.11
See application file for complete search history.

(56) References Cited

U.S. PATENT DOCUMENTS 4,990,930 A * 2/1991 Ludden et al. ..... 347/172
6,034,707 A * 3/2000 Agano ..... 347/211
6,249,299 B1 * 6/2001 Tainer ..... 347/191

FOREIGN PATENT DOCUMENTS

JP 5-220946 A 8/1993
JP 6-54150 A 2/1994

* cited by examiner

*Primary Examiner*—K. Feggins
(74) *Attorney, Agent, or Firm*—Sughrue Mion, PLLC

(57) ABSTRACT

A system controller of a color thermal printer obtains a density profile of an image with respect to a feeding direction of a color thermal recording paper based on density of a test print measured by a CCD line sensor, and then extracts a density unevenness component, which fluctuates periodically, from the density profile. The system controller relates the density unevenness component in one period to a rotating position of a feed motor so as to create a period profile of a driving pulse to offset the unevenness component. When recording the image, the driving pulse is given to the feed motor based on the period profile, so that the drive of the feed motor is controlled.

9 Claims, 4 Drawing Sheets

IMAGE FORMING APPARATUS AND DENSITY UNEVENNESS PREVENTING METHOD

BACKGROUND OF THE INVENTION

1. Field of the Invention

The present invention relates to a method for preventing density unevenness in an image with respect to a feeding direction of a recording material, and an image forming apparatus having a function for preventing density unevenness.

2. Description of the Prior Arts

As an image forming apparatus for recording an image on a recording material, there are an inkjet printer with an inkjet head and a thermal printer with a thermal head. In these printers, the recording material is fed by a feed roller pairs to be driven by a motor.

In the above-mentioned image forming apparatus, the feeding speed of the recording material may be uneven mainly due to an eccentric or distorted rotation shaft of the motor, and this may cause density unevenness in the image along the feeding direction of the recording material. The density unevenness occurs periodically. Therefore, the parts for the feed transport driving system, from the motor to the feed roller pairs, are made and assembled as accurate as possible in the prior art image forming apparatus.

In the image forming apparatus disclosed in Japanese Patent Laid-Open Publication No. 5-220946, the density of an image pattern recorded at a predetermined density is measured, and then a correction data is created for correcting the image signal to be output to each recording element of the recording head according to the detected density, so that the image is recorded based on the image signal corrected by the correction data. In addition, Japanese Patent Laid-Open Publication No. 6-54150 discloses the jitterless image forming apparatus in which the driving unevenness of the photoreceptor for feeding the recording paper is detected and the writing timing of the optical writer is altered according to the detected driving unevenness signal.

In the prior art image forming apparatus, although the parts accuracy of the feed driving system is enhanced in order to eliminate the density unevenness due to the unevenness in the feeding speed, there arises a problem that the parts cost is increased. In addition, the above-mentioned image forming apparatuses deter the occurrence of the density unevenness by controlling the driving timing of the recording head and the optical writer; however, since the output from the recording head and the optical writer are greatly influenced by incidental parameters such as environmental temperature and humidity around the image forming apparatus, it is difficult to prevent the density unevenness surely.

SUMMARY OF THE INVENTION

An object of the present invention is to provide an image forming apparatus in which density unevenness can be surely prevented without increasing parts cost, and a method for preventing the density unevenness.

In order to achieve the above and other objects, the image forming apparatus of the present invention is provided with a speed control profile on the density unevenness in one period. The rotation of a motor for feeding a recording material is controlled based on the speed control profile (period profile). The speed control profile is created based on the density of a test print.

A test pattern recorded on the test print is measured by a density measuring sensor. A density profile with respect to the feeding direction of the recording material is created based on the density measurement. The density unevenness to change periodically is extracted from the density profile to obtain a relationship between a motor rotating position and the amount of density variation (density unevenness component) of the density unevenness in one period. The density unevenness in one period is a distance from a first position showing first reference density in the test print to a second position showing the subsequent reference density. The feeding distance of the recording material from the print start to the first position is stored. The motor speed is controlled in reference to the speed control profile on each distance of one period from the first position. The speed control profile lengthens a period of a driving pulse at the motor rotating position where the density is low, while shortens the period at the motor rotating position where the density is high.

In a preferred embodiment of the present invention, a pulse motor driven by the driving pulse is used. The period profile is used as the speed control profile. The period of the driving pulse to the motor rotating position is determined by the period profile.

In another preferred embodiment of the present invention, the image forming apparatus is provided with a sensor for detecting the step-out of the motor and an alarm for indicating the test printing when the step-out is detected.

According to the image forming apparatus and the density unevenness preventing method of the present invention, the motor speed is controlled based on the speed control profile (period profile) in recording the image, so that the density unevenness can be surely prevented without increasing the parts cost.

BRIEF DESCRIPTION OF THE DRAWINGS

The above and other objects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein.

DETAILED DESCRIPTION OF THE PREFERRED EMBODIMENTS

Figure 1:
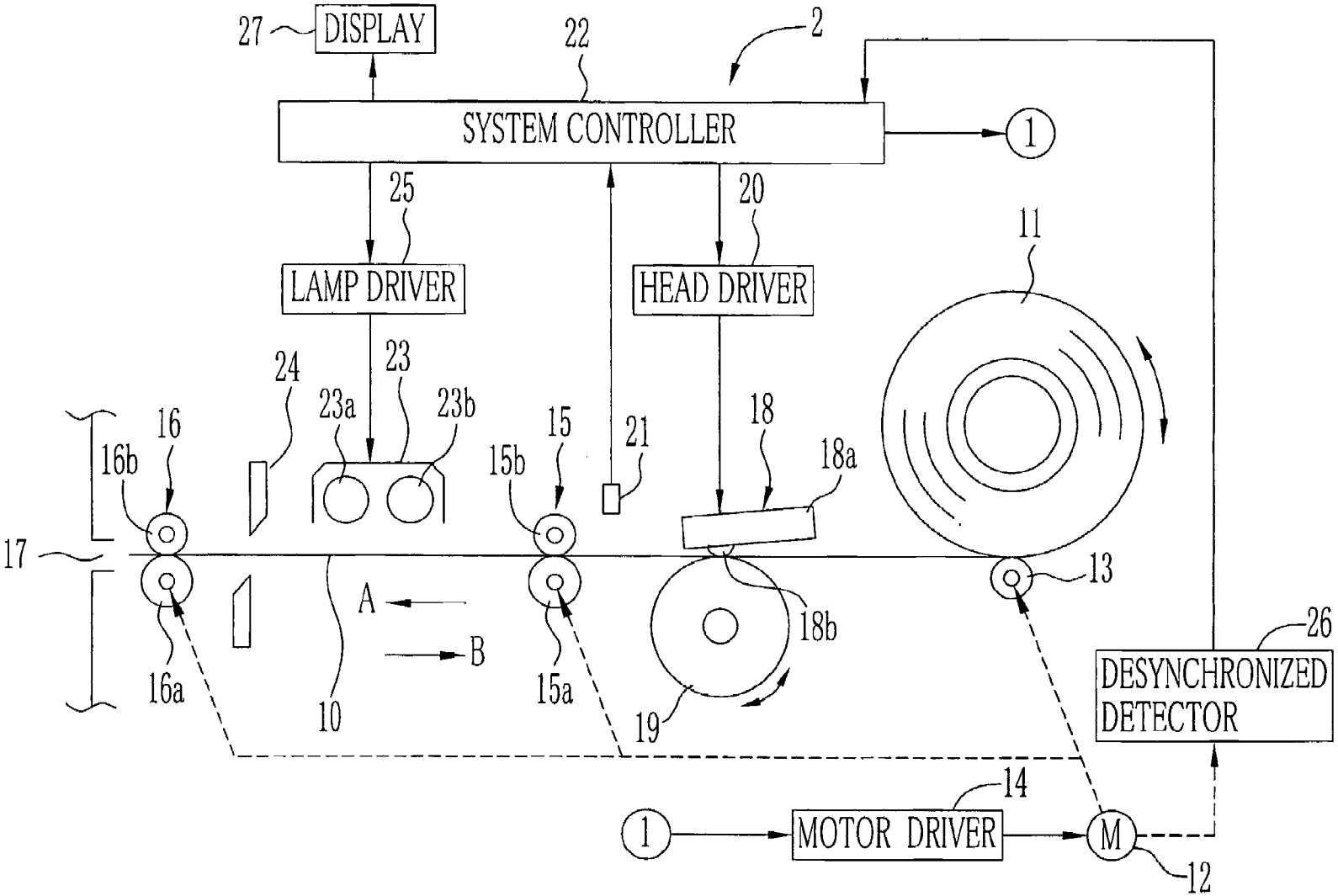
FIG. 1 is a schematic view showing a structure of a color thermal printer to which the present invention is applied.

In FIG. 1, a continuous color thermal recording paper 10 is used as a recording material in a color thermal printer 2. The color thermal recording paper 10, which is wound into a roll shape, is loaded into the color thermal printer 2 as a recording paper roll 11.

Figure 2:
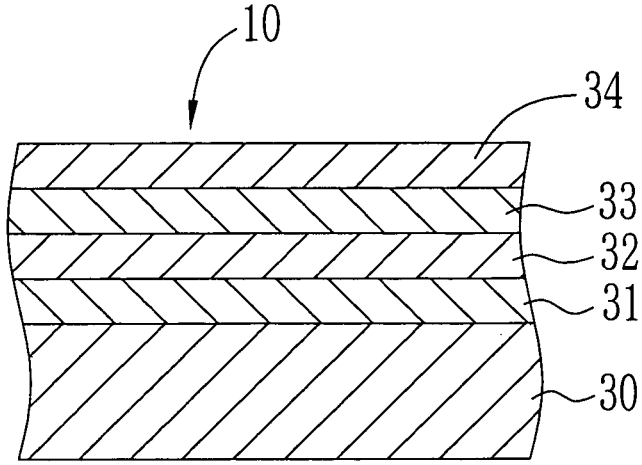
FIG. 2 is a cross-sectional view showing a structure of a color thermal recording paper.

As shown in FIG. 2, the color thermal recording paper 10 includes a cyan thermosensitive coloring layer 31, a magenta thermosensitive coloring layer 32, a yellow thermosensitive coloring layer 33, and a protective layer 34 overlaid on a support 30 in sequence. The yellow thermosensitive coloring layer 33, which is the uppermost layer, has the highest heat sensitivity and develops the yellow color by application of relatively low heat energy. The cyan thermosensitive coloring layer 31, which is the lowermost layer, has the lowest heat sensitivity and develops the cyan color by application of relatively high heat energy.

The yellow thermosensitive coloring layer 33 loses its coloring ability when near-ultraviolet rays of a wavelength peaking at 420 nm are applied thereto. The magenta thermosensitive coloring layer 32 develops the magenta color in heat energy between the necessary energy for coloring the yellow and cyan thermosensitive coloring layers, and loses its coloring ability when ultraviolet rays of a wavelength peaking at 365 nm are applied thereto. Note that a color thermal recording paper may have a four layer structure by adding a black thermosensitive coloring layer.

In FIG. 1, a feed roller 13 to be rotated by a feed motor 12 is in contact with a periphery of the recording paper roll 11. The feed motor 12 is a stepping motor and driven by the driving pulse from a motor driver 14. When the feed roller 13 is rotated in a counter clockwise direction, the recording paper roll 11 is rotated in a clockwise direction to feed the color thermal recording paper 10. When the feed roller 13 is rotated in the clockwise direction, the recording paper roll 11 is rotated in the counter clockwise direction to rewind the color thermal recording paper 10.

The color thermal recording paper 10 fed from the recording paper roll 11 is set in a feeding path disposed in a horizontal direction. A feed roller pair 15 for sandwiching and feeding the color thermal recording paper 10 and a discharge roller pair 16 are disposed in the feeding path. These two roller pairs are respectively constituted of capstan rollers 15*a*, 16*a* to be rotated by the feed motor 12 and pinch rollers 15*b*, 16*b* pushed against the capstan rollers 15*a*, 16*a*. The feed roller pair 15 and the discharge roller pair 16 feed the color thermal recording paper 10 reciprocally in A direction (advancing direction) and in B direction (withdrawing direction). An exit opening 17 for discharging the color thermal recording paper 10 with the image recorded is disposed on the downstream side of the discharge roller pair 16 in the A direction.

A thermal head 18 and a platen roller 19, which is disposed below the feeding path so as to face the thermal head 18, are provided between the feed roller 13 and the feed roller pairs 15. The thermal head 18 is constituted of a head substrate 18*a* made from ceramic, alumina, alumina ceramic or the like and a heating element array 18*b* which is provided on a bottom surface of the head substrate 18*a* and includes a large number of heating elements arranged linearly.

The heating element array 18*b* generates heat based on driving data put into a head driver 20 to color each thermosensitive coloring layer 31–33 of the color thermal recording paper 10. The platen roller 19 is rotated in accordance with the feeding of the color thermal recording paper 10 to stabilize a contact of the color thermal recording paper 10 to the heating element array 18*b*. In addition, the platen roller 19 can move up and down and biased toward the heating element array 18*b* by a spring (not shown). When the color thermal recording paper 10 is fed or discharged, the platen roller 19 moves down by a shift mechanism (not shown) which is constituted of a cam, a solenoid and so on to release the color thermal recording paper 10 from the nip of the platen roller 19 and the thermal head 18.

A CCD line sensor 21 for measuring density of the image recorded on the color thermal recording paper 10 is disposed on the downstream side of the feed roller pair 15 in the A direction. The measurement result by the CCD line sensor 21 is sent to a system controller 22.

A fixer 23 is disposed so as to face a recording surface of the color thermal recording paper 10 on the downstream side of the feed roller pair 15 in the A direction. A cutter 24 for cutting the color thermal recording paper 10 into a predetermined print size is disposed between the fixer 23 and the discharge roller pair 16. The fixer 23 is constituted of a yellow fixing light source 23*a* for emitting the near-ultraviolet rays whose light-emitting peak is 420 nm to fix the yellow thermosensitive coloring layer 33 and a magenta fixing light source 23*b* for emitting the near-ultraviolet rays whose light-emitting peak is 365 nm to fix the magenta thermosensitive coloring layer 32. These light sources 23*a*, 23*b* are driven by a lamp driver 25.

It is preferable to provide a step-out detector 26, for example a rotary encoder, for detecting the step-out of the feed motor 12 as well as an alarm such as a display 27 for displaying a message to prompt an operating person to create a test print (entirely, solid gray, for example). Thereby, it is possible to correct rapidly the unevenness of the period profile caused by the step-out of the feed motor 12.

Figure 3A:
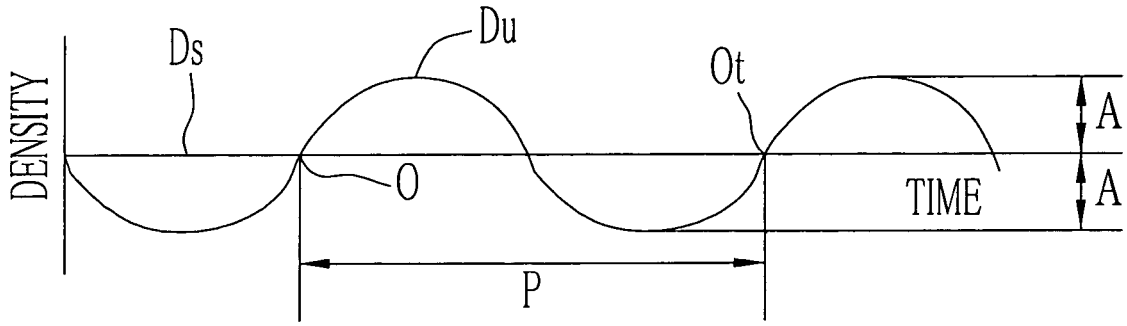
FIG. 3A is a graph showing density unevenness components extracted from a density profile.

In the color thermal printer 2, the test printing is performed and then the density of the test print is measured by the CCD line sensor 21. The system controller 22 calculates average value of the output from the CCD line sensor 21 with respect to each measurement line. A density profile of the image along the feeding direction of the color thermal recording paper 10 is obtained from the density average value. As shown in FIG. 3A, a density unevenness component Du (amplitude: A, period: P) which fluctuates periodically is extracted from the density profile obtained by the test print.

Figure 3B:
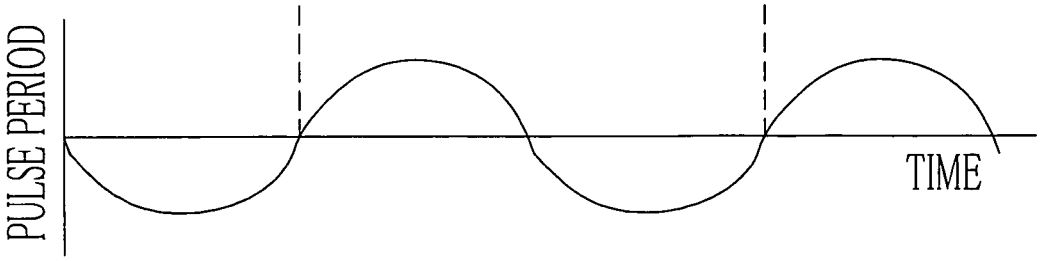
FIG. 3B is a graph showing a period of a driving pulse given to a feed motor.

The system controller 22 relates the extracted density profile component Du in one period (P) to the rotating position of the feed motor 12 and stores it in a RAM (not shown). Subsequently, a period profile of the driving pulse to the feed motor 12 is created from the relationship between the period P and the rotating position so as to offset the amplitude A in the density unevenness component Du. Namely, the period profile acts to make the pulse period short for a low-density portion to reduce the feeding speed, while it makes the pulse period long for a high-density portion to accelerate the feeding speed as shown in FIG. 3B, so that the feeding speed of the color thermal recording paper 10 remains constant. The period profile is stored in the RAM in the system controller 22.

In order to relate the density unevenness component Du in one period to the rotating position of the feed motor 12, the first intersect point of the density unevenness component Du with a reference density Ds in the test printing is determined as an absolute original position O. Then the driving pulse given to the feed motor 12 from the start to the absolute original portion O is stored as a counted value Na, while the driving pulse from the absolute original point O to a point Ot, which is one period from the point O, is stored as a counted value Nb. As another method, a certain point is determined as the absolute original point after a certain period in the test printing, then the counted value of the driving pulse at this absolute original point and the counted value of the driving pulse at the point in one period from the absolute original point may be stored.

A data table showing the relationship between the amplitude A of the density unevenness component Du and the pulse period for offsetting the amplitude A are preliminary stored in a ROM of the system controller 22. The pulse period is determined based on the data table to create the period profile.

When the image is recorded actually, the speed of the feed motor 12 falls under control when the color thermal recording paper 10 has arrived at the absolute original point O, and then the speed of the feed motor 12 is controlled by changing the period of the driving pulse in reference to the period profile on each distance of one period (the counted value Nb). Until the Na-th pulse counted from the start of the image recording, the point corresponding to the Na-th pulse is extracted by calculating back from the latter half of the period profile.

Figure 4:
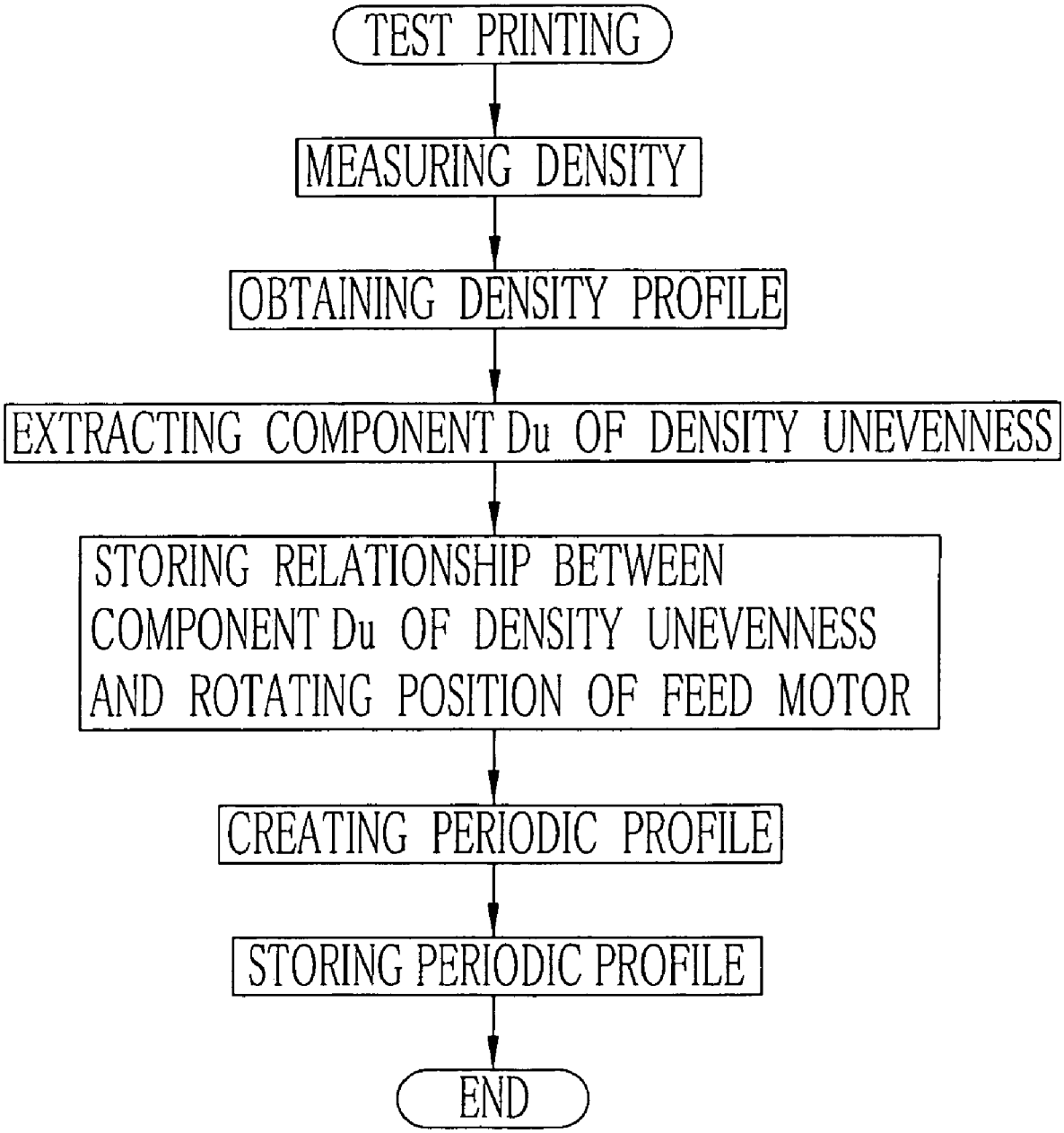
FIG. 4 is a flow chart showing processing procedure in test printing.

Next, the operation of the color thermal printer 2 having the above-mentioned constitution is explained by referring to the flow chart in FIG. 4. First, the test print is obtained before the image recording, and then its density is measured by the CCD line sensor 21. In the system controller 22, the density profile of the image along the feeding direction of the color thermal recording paper 10 is obtained from the density measurement result of the test print. Second, the density unevenness component Du fluctuating periodically is extracted from the density profile.

After extracting the density unevenness component Du, the density unevenness component Du in one period and the rotating position of the feed motor 12 are related to each other to be stored in RAM of the system controller 22. The period profile of the driving pulse for the feed motor 12 to offset the amplitude A of the density unevenness component Du is created from the relationship between the period P and the rotating position, and then it is stored in the RAM.

When the image recording operation is started after storing the period profile, the feed motor 12 is rotated in the normal direction to rotate the feed roller 13 in the counter clockwise direction, so that the color thermal recording paper 10 from the recording paper roll 11 is advanced in the A direction. The front end of the color thermal recording paper 10 is passed through the feeding path to be nipped by the feed roller pair 15, and then advanced to the downstream side in the A direction.

When the color thermal recording paper 10 reaches an image recoding starting position, the feed motor 12 temporarily stops rotating. Subsequently, the platen roller 19 is moved up by the shift mechanism to hold the color thermal recording paper 10 with the heating element array 18*b*, and then the feed motor 12 is driven again in this state. After that, while the color thermal recording paper 10 is advanced in the A direction, the yellow image is recorded in the yellow thermosensitive coloring layer 33 of the color thermal recording paper 10 by the heating element array 18*b* which has been heated in accordance with the driving data put into the head driver 20. At this time, the pulse number to be given to the feed motor 12 from the motor driver 14 is managed by referring to the period profile, so that the density unevenness is corrected.

After recording the yellow image, the color thermal recording paper 10 is advanced until a rear end of the recorded image faces the yellow fixing light source 23*a* of the fixer 23, and then the feed motor 12 stops rotating. At this time, the platen roller 19 is moved down by the shift mechanism to release the holding of the color thermal recording paper 10 with the thermal head 18. Subsequently, the yellow fixing light source 23*a* is turned on by the lamp driver 25. The yellow thermosensitive coloring layer 33 with the image recorded is fixed while the color thermal recording paper 10 is withdrawn in the B direction by rotating the feed motor 12 in the backward direction.

After the yellow thermosensitive coloring layer 33 has been fixed, the color thermal recording paper 10 is advanced until the front end of the recorded image faces the heating element array 18*b*, and then the feed motor 12 stops rotating. As with the yellow image recording, the platen roller 19 is moved up by the shift mechanism to hold the color thermal recording paper 10 with the heating element array 18*b*, and then the feed motor 12 is driven again in this state. After that, while advancing the color thermal recording paper 10 in the A direction, the magenta image is recorded on the magenta thermosensitive coloring layer 32. In addition, as with the yellow image recording, the pulse number to be given to the feed motor 12 from the motor driver 14 is managed by referring to the period profile, so that the density unevenness is corrected.

After recording the magenta image, the color thermal recording paper 10 is advanced until the rear end of the recorded image faces the magenta fixing light source 23*b* of the fixer 23, and then the feed motor 12 stops rotating. Subsequently, as with the yellow image fixing, the magenta fixing light source 23*b* is turned on by the lamp driver 25. The magenta thermosensitive coloring layer 32 with the image recorded is fixed while the color thermal recording paper 10 is withdrawn in the B direction by rotating the feed motor 12 in the backward direction.

After the magenta thermosensitive coloring layer 32 has been fixed, the color thermal recording paper 10 is advanced until the front end of the recorded image faces the heating element array 18*b*, and then the feed motor 12 stops rotating. As with the yellow and magenta image recordings, the cyan image is recorded on the cyan thermosensitive coloring layer 31, and then the density unevenness is corrected.

The color thermal recording paper 10 with the cyan image recorded is advanced in the A direction by the feed roller pairs 15, and then discharged from the exit opening 17 by the discharge roller pairs 16 after being cut into the predetermined print size by a cutter 24.

Due to the above-mentioned constitution, the density unevenness is surely eliminated without depending on the parts accuracy of the feed driving system, so that a high-quality print can be obtained. In addition, since the feeding speed of the color thermal recording paper 10 is kept constant to eliminate the density unevenness, the image density is not influenced by environmental temperature and humidity around the image forming apparatus.

Figure 5:
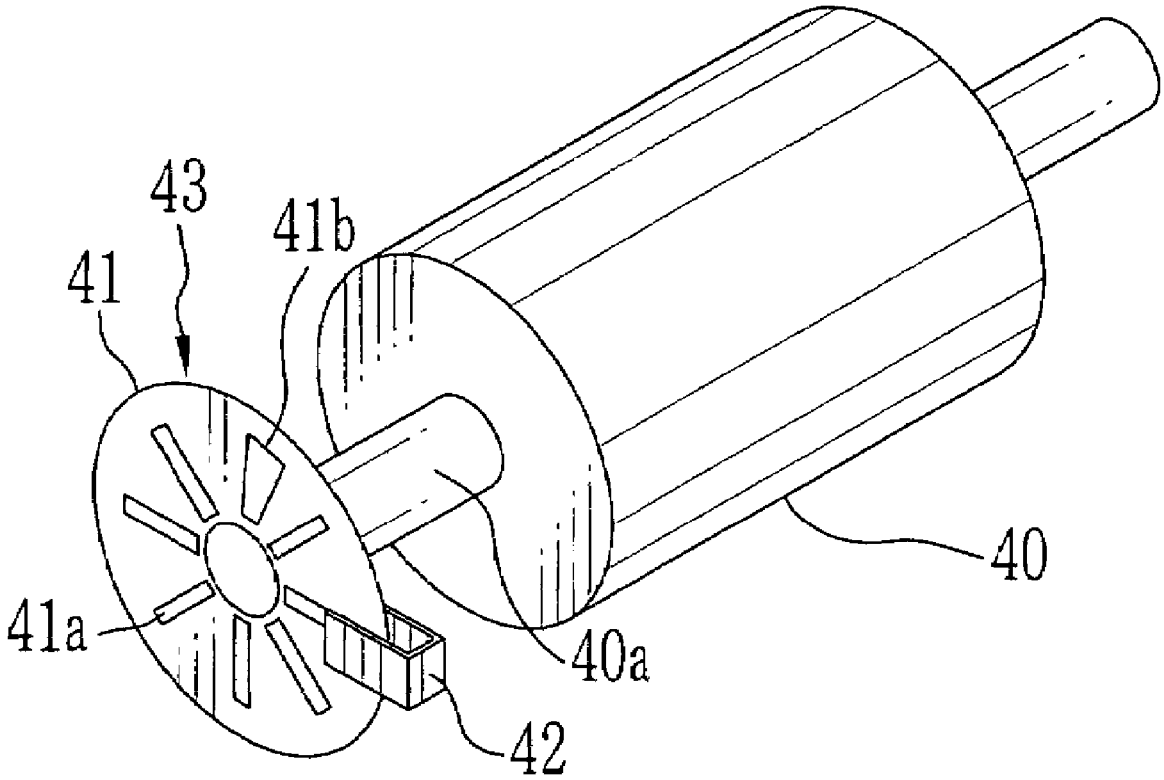
FIG. 5 is a view showing an embodiment where a DC motor is used as the feed motor.

As the feed motor 12, not only the stepping motor but a DC motor may be applicable. If the DC motor is used, as shown in FIG. 5, an encoder 43 constituted of a detecting plate 41 and a photo interrupter 42 is attached to a rotation shaft 40*a* of a feed motor 40 as the DC motor. The detecting plate 41 has a detecting hole 41*b* at the point of origin and, slit-like detecting holes 41*a* formed every 45 degrees from the detecting hole 41*b*. The photo interrupter 42 detects the passage of the detecting holes 41*a* and 41*b*. The detecting hole 41*b* is determined as the absolute original point O of the rotating position of the feed motor 40, and the density unevenness component Du in one period and the rotating position of the feed motor 40 are related to each other, so that the period profile is created as in the foregoing embodiment. When the image is recorded actually, the electric power to be given to the feed motor 40 from the motor driver 14 is managed by referring to the period profile and the detection result by the photo interrupter 42, so that the density unevenness is corrected.

When the period profile is created, the test printing may be executed not only before the image recording but in a predetermined timing in a standby state of the image recording operation. Meanwhile, the operating person may select whether the test printing is executed.

In the above embodiment, although the color thermal printer is explained as an example, another type of the printer such as a monochrome type, a heat-transfer type, a dye-sublimation type, an ink jet type or the like may be applied to the present invention.

It is to be understood that the above-described embodiments are simply of the invention. Other embodiments may be devised by those skilled in the art which will embody the principal of the invention and fall within the sprit and scope thereof.

What is claimed is:

1. An image forming apparatus having a recording head, said recording head recording an image on a recording material which is fed by a feed roller pair driven by a motor, said image forming apparatus comprising;

a density measuring sensor for measuring density of a test print, said test print being recorded by said recording head;

first creating means for creating a density profile with respect to a feeding direction of said recording material based on the measurement result of said density measuring sensor;

extracting means for extracting density unevenness from said density profile, and then obtaining a relationship between a rotating position of said motor and the amount of density variation to said density unevenness in one period, said density unevenness changing periodically;

second creating means for creating a speed control profile on said density unevenness in one period so as to increase or decrease the speed of said motor in response to said amount of density variation; and control means for controlling speed of said motor based on said speed control profile.

2. An image forming apparatus as claimed in claim 1, wherein said one period represents a distance from a first position showing a first reference density in said test print to a second position showing the subsequent reference density.

3. An image forming apparatus as claimed in claim 2, wherein said motor is a pulse motor driven by a driving pulse.

4. An image forming apparatus as claimed in claim 3, further comprising: a counter for counting the number of said driving pulse from a test-print starting position, when said image is recorded on said recording material, the speed of said motor is controlled in reference to said speed control profile on each distance of said one period after reaching the pulse number corresponding to said first position.

5. An image forming apparatus as claimed in claim 4, wherein said speed control profile lengthens a period of said driving pulse at a motor rotating position where said density is low, while shortens said period at the motor rotating position where said density is high.

6. An image forming apparatus as claimed in claim 5, further comprising:

a sensor for detecting step-out of said motor; and an alarm for indicating said test printing when said step-out is detected.

7. A density unevenness preventing method for an image forming apparatus, said image forming apparatus being provided with a feed roller pair for feeding a recording material, a motor for rotating said feed roller pair and a recording head for recording an image on said recording material being fed, said density unevenness preventing method comprising the steps of:

creating a test print by recording a test pattern on said recording material;

measuring density of said test print;

creating a density profile with respect to a feeding direction of said recording material based on the measurement of said density;

obtaining a relationship between a motor rotating position and the amount of density variation to density unevenness in one period after extracting said density unevenness which changes periodically;

creating a speed control profile on said density unevenness in one period so as to increase or decrease the speed of said motor in response to said amount of density variation; and controlling the speed of said motor based on said speed control profile when recording said image on said recording material.

8. A density unevenness preventing method as claimed in claim 7, wherein said motor is a pulse motor driven by a driving pulse.

9. A density unevenness preventing method as claimed in claim 8, wherein said speed control profile lengthens a period of said driving pulse at a motor rotating position where said density is low, while shortens said period at the motor rotating position where said density is high.

* * * * *